US005367132A

United States Patent [19]

Skalski et al.

[11] Patent Number: 5,367,132

[45] Date of Patent: Nov. 22, 1994

[54] CENTERING CONTROL FOR ELEVATOR HORIZONTAL SUSPENSION

[75] Inventors: Clement A. Skalski; Boris Traktovenko, both of Avon, Conn.

[73] Assignee: Otis Elevator Company, Farmington, Conn.

[21] Appl. No.: 68,491

[22] Filed: May 27, 1993

[51] Int. Cl.[5] ..... B66B 1/44

[52] U.S. Cl. ..... 187/393

[58] Field of Search ..... 187/100, 115, 113, 117, 187/1 R, 95; 104/284, 297; 280/715, 725, 720

[56] References Cited

U.S. PATENT DOCUMENTS

| | | | |
|---|---|---|---|
| 4,754,849 | 7/1988 | Ando . | |
| 5,086,882 | 2/1992 | Sugahara et al. . | |
| 5,117,946 | 6/1992 | Traktovenko et al. . | |
| 5,193,651 | 3/1993 | Shigeta et al. . | |
| 5,304,751 | 4/1994 | Skalski et al. | 187/115 |

FOREIGN PATENT DOCUMENTS

| | | |
|---|---|---|
| 0467673 | 1/1992 | European Pat. Off. . |
| 58-39753 | 9/1983 | Japan . |
| 60-15374 | 1/1985 | Japan . |
| 61-22675 | 6/1986 | Japan . |
| 63-87483 | 4/1988 | Japan . |
| 5-24768 | 2/1993 | Japan . |
| 2238404 | 5/1991 | United Kingdom . |

*Primary Examiner*—Kristine L. Peckman
*Assistant Examiner*—Robert Nappi
*Attorney, Agent, or Firm*—Francis J. Maguire, Jr.

[57] ABSTRACT

An improved centering control for an elevator horizontal suspension having at least one actuator and includes a circuit for disabling the control or braking the actuator in response to an error signal indicative of the difference between a reference signal and a sensed signal indicative of the degree of centering of the car. Of course, both braking and disabling may be carried out instead of just one. For those cases in which two actuators are acting in concert to center the car, where the control is responsive to the error signal for only selecting one of the opposed actuators at a time, a small centering window is set up about the centered condition and part of the window is used to disable or brake one of the actuators and another part to disable or brake the other of the actuators. Again, both disabling and braking operations may be carried out at the same time with respect to a given actuator. For a centering control in which opposed actuators are used with individual feedback control loops to achieve a preselected preload, the improved control only uses the feedback loop when the corresponding actuator is unselected for actuation.

17 Claims, 8 Drawing Sheets

0 = REFERENCE POINTS

GAP1 = - POS - XRAIL1 + GAP10

GAP2 = POS - XRAIL2 + GAP20

V1 ON WHEN CENTERED
+15
R46 4.7K
U4 LM339 VCOMP
Y X>Y Q
X
13
10
11
14
8
9
LM339 U4
JP1
JP2
SS 2
FB 3
SS 5
FB 6
318
312
316
R26 100K
R27 10K
R28 3.3K
D5
1N4148
320
362
U5 LM339 VCOMP
356
344
340
355
382
360
E1
330
R39 100K
U1 LM324
R20 100K
U3 LM324
R51 49.9K
R40 100K
P3 10K
R38 100K
R54 49.9K
R19 100K
342
R49 49.9K
P4 10K
D2
D1
R15 10K
326
U3 LM324
R13 10K
R14 10K

CENTERING CONTROL FOR ELEVATOR HORIZONTAL SUSPENSION

TECHNICAL FIELD

This invention relates to elevators and, more particularly, to active horizontal suspensions therefor.

BACKGROUND OF THE INVENTION

In European Patent Application No. 91306517 published on Jan. 22, 1992 under Publication No. 0467673A2, an elevator active suspension system was disclosed showing a method and apparatus for actively counteracting a disturbing force acting horizontally on an elevator platform moving vertically in a hoistway. In particular, as it relates to the invention disclosed herein, a control scheme is shown in FIG. 69 thereof for a pair of active guides. Even more particularly, a centering control is shown for counteracting low frequency, relatively large forces tending to de-center, shift, cant or otherwise tip the car from a steady horizontal position as it moves up and down the hoistway. A similar centering control is shown in FIG. 9 of U.S. Pat. No. 5,117,946. Both of the above-mentioned documents disclose inventions assigned to assignee hereof.

The details of an exemplary elevator horizontal suspension is shown in the above-mentioned U.S. Pat. No. 5,117,946 particularly at column 5, line 56 and concluding at column 6, line 66, which is hereby incorporated by reference along with the related Figures in the drawing thereof.

Also in both of the above-mentioned documents, an elevator horizontal suspension is shown on opposite sides of an elevator car. Both front to back and side to side suspension controls are considered, the front-to-back control being much simpler than the side-to-side control on account of a need, in the side-to-side control, for comparing the position of the car with respect to both rails on opposite sides of the hoistway and centering the car with respect thereto. Two separate front to back controls can be handled independently, if desired, with respect to the separate rails.

During extensive testing of the system disclosed in the above-mentioned documents it was found that the filters and compensation were be difficult to select in a way that permitted the control to be fast enough to satisfy the objectives for quickly centering the car yet slow enough to maintain stability. It was also found that, for a geared motor control that was back-driveable, there was an undesired back driving phenomenon when forces were sufficient to overcome the rather weak control provided in background for the homing control, primarily for the actuator not being utilized. The intent of the homing control was to maintain a constant preload on the unselected roller. In other words, while one of the actuators was actively centering the car the other we designed to be returned to a home position using a weak control primarily intended for use when the actuator was not being utilized to center the car but nonetheless left on all the time.

DISCLOSURE OF INVENTION

An object of the present invention is to improve the responsiveness of the above described centering control for an elevator horizontal suspension while maintaining stability.

According to a first aspect of the present invention, a braking control is provided for an elevator horizontal suspension actuator at selected points.

In further accord with the first aspect of the present invention, a braking control is responsive to a position signal for providing a braking control signal for braking an elevator horizontal suspension actuator during a position window in a positional range centering on the elevator horizontal center position.

The use of a brake, as described above, provides advantages in permitting a back-driveable actuator to be stopped from being back driven when such would be undesirable, as expected, but also such an approach unexpectedly proved to make a major difference in the speed of response achievable on account of the damping effect of the brake on the centering controls. It is found that the brake controls enhance both front-to-back and side-to-side centering controls. The brake control circuits were made to function quickly by basing control on position error. By clamping the actuator in the selected position zone an unexpected damping effect was achieved that allowed the responsiveness of the centering control to be greatly enhanced. As a result, a time constant of two seconds was able to be used in the gain and lag controller.

According to a second aspect of the present invention, a disable control is provided for an elevator horizontal suspension actuator for disabling the actuator at selected points.

In further accord with the second aspect of the present invention, a disable control is responsive to a position signal for providing a disable control signal for disabling an elevator horizontal suspension actuator during a position window in a positional range centering on the elevator horizontal center position.

The use of a disable control, as described above in accordance with the second aspect of the present invention, provides advantages in permitting a back-driveable actuator to be stopped from being controlled when such would be undesirable, as expected, but also such an approach unexpectedly proved to make a major difference in the speed of response achievable on account of the disabling of the control. It is found that the disable control enhances both front-to-back and side-to-side centering controls. The disable control was made to function quickly by basing it on position error. By disabling the actuator in the selected positional zone an unexpected control effect was achieved that allowed a greatly enhanced responsiveness of the centering control to be achieved. As a result, a time constant of two seconds was able to be used in the gain and lag controller.

According to a third aspect of the present invention, while one of the opposed side-to-side horizontal suspension actuators is actively being used to center the car, its homing position control is disabled while that of the other, unselected actuator is activated for homing its actuator to achieve the desired preload. Thus, it was found necessary to selectively engage the "home" position controls. In comparison to the strong centering control, the homing position controls were previously thought to be of relatively weak effect in comparison thereto and were left on all of the time. It was found necessary, according to the teachings hereof, to selectively engage the "home" position controls. While one of the actuators is being used to center the car, its homing control is deactivated and only the opposite actuator is sought to be brought back to the desired preload condition. This improvement was found to increase stability significantly.

In accordance with a fourth aspect of the present invention, instead of returning the unselected actuator to a home position related to the car frame, the home position is selected to always maintain the same compression of the unselected suspension spring. This maintains a constant preload on the unselected roller and is found to be a superior approach over that previously disclosed in the above-mentioned documents.

These and other objects, features and advantages of the present invention will become more apparent in light of the following detailed description of a best mode embodiment thereof, as illustrated in the accompanying drawing.

BEST MODE FOR CARRYING OUT THE INVENTION

Figure 1:
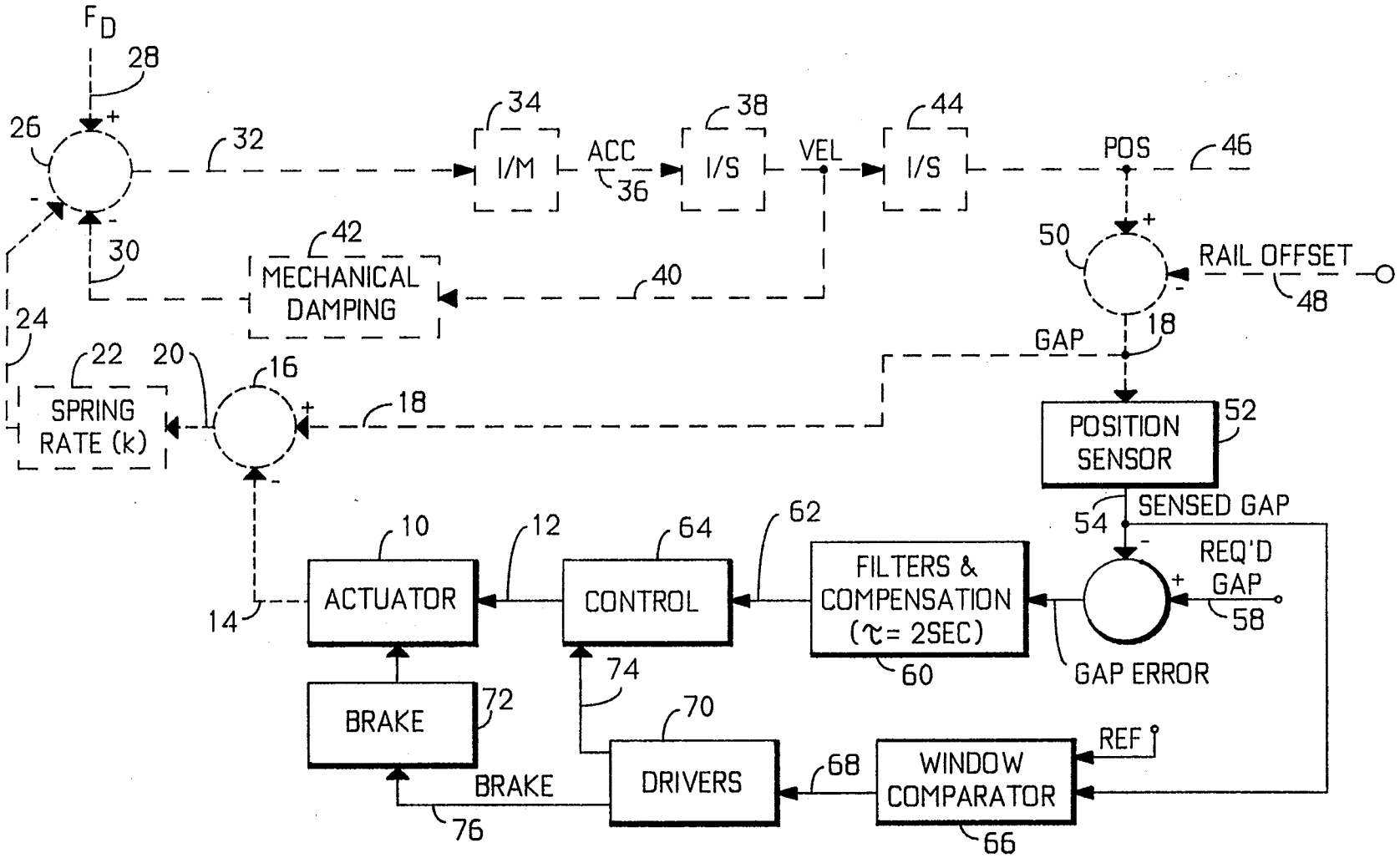
FIG. 1 shows a front to back control for an active horizontal elevator suspension, according to the present invention.

FIG. 1 shows a front to back control for an elevator active horizontal suspension. A front to back actuator 10, such as described in the above-mentioned U.S. Pat. No. 5,117,946, is responsive to a control signal on a line 12 for providing a mechanical output on a line 14 for moving the elevator car horizontally with respect to a vertical hoistway rail. The force supplied by the output on the line 14 is in effect summed, as represented by a summer 16, with a GAP signal on a line 18 to provide a summed signal on a line 20 which is applied through a spring rate (K) 22 on a line 24 to a summer 26. The dashed lines in FIG. 1 represent mechanical aspects of the system upon which the actuator, brake, control, etc. operates and with which it forms a part of a total system. In other words, the active suspension is shown in solid lines. Thus, a disturbing force, as represented generally by a line 28, is summed with the force applied by the actuator on the line 24, along with a mechanical damping signal on a line 30 to provide a summed signal on a line 32 to an elevator car 34 as represented by a mass (M). The summed signal on the line 32, in effect represents a force error signal for the overall control system represented in FIG. 1, i.e., being the difference between the disturbing force on the line 28 and the counteracting force provided by the actuator 10. The force error signal on the line 32 will accelerate the elevator car 34 as indicated by an acceleration on a line 36 which is integrated by the system, as indicated in an integration block 38 to manifest a velocity signal on a line 40 which is supplied to both a mechanical damping block 42 and another integration block 44. The mechanical damping signal on the line 30 has already been discussed and simply represents the result of mechanical damping of the system on the velocity component on the line 40. The output of block 44 on line 40 is the position of the car. It will be understood that the blocks 34, 38, 42 and 44 represent the mass properties of the elevator car.

The position signal on the line 46 may be referenced to zero when the elevator car is perfectly centered from front-to-back in the elevator hoistway, at least with respect to a particular rail. Thus, assuming a perfectly vertical rail surface, the GAP between the elevator car and the rail will be equal to the position signal on the line 46. However, the rails are not perfectly vertical and a rail offset signal on a line 48 must be accounted for as indicated by a summer 50 taking the difference between the signal on the line 46 and the signal on the line 48 to provide the GAP signal on the line 18 to a position sensor 52 which may form part of a control according to the present invention. The sensor 52 is an idealized position sensor with unity transfer function. It will again be noted that the lower part of FIG. 1 that is shown in solid lines represents the control and actuator part of the system which in most cases forms most of the active part of the suspension described herein. Also typically included will be a roller, a spring, and the like.

The position sensor 52 provides a sensed position signal on a line 54 which is provided to a summing junction 56 which compares the sensed position signal on the line 54 to a required or reference GAP signal on a line 58. A GAP error signal is provided by the summer 56 as a difference between the signal on the line 54 and the signal on the line 58 and is provided to a block 60 which represents filters and compensation for providing a filtered and compensated signal on a line 62 to a control 64 which in turn provides the control signal on the line 12 to the actuator 10 as described previously.

All of the foregoing descriptions in FIG. 1 are consistent with the disclosure already published in U.S. Pat. No. 5,117,946 and EPO Publication 0 467 673 A2.

According to the teachings of the present invention, the sensed GAP signal on the line 54 is also provided to a window comparator 66 with hysteresis which determines whether or not the magnitude of the sensed GAP signal is within a selected range which would typically be centered on a desired zero position corresponding to the elevator being centered with respect to the rail in the hoistway. The horizontal positional window about the center reference point could be on the order of a fraction of a millimeter or more, for example. The window comparator 66 will provide a disable signal on a line 68 when the sensed GAP signal on the line 54 is within the desired window. A pair of drivers 70, one for the control 64 and another for a brake 72 provide a control disable signal on a line 74 and a brake engage signal on a line 76 for respectively shutting off the control 64 and engaging the brake 72 while the sensed GAP signal is in the selected positional window about the center position of the elevator car. This clamping of the actuator 10 and shutting off of the control 64 during this small window creates a damping effect that is highly advantageous, according to the teachings of the present invention, for permitting the filters and compensation block 60 to provide a fast time constant, on the order of two seconds, thereby making the overall centering control system highly responsive and at the same time permitting excellent stability characteristics to be achieved.

Figures 4, 4A:
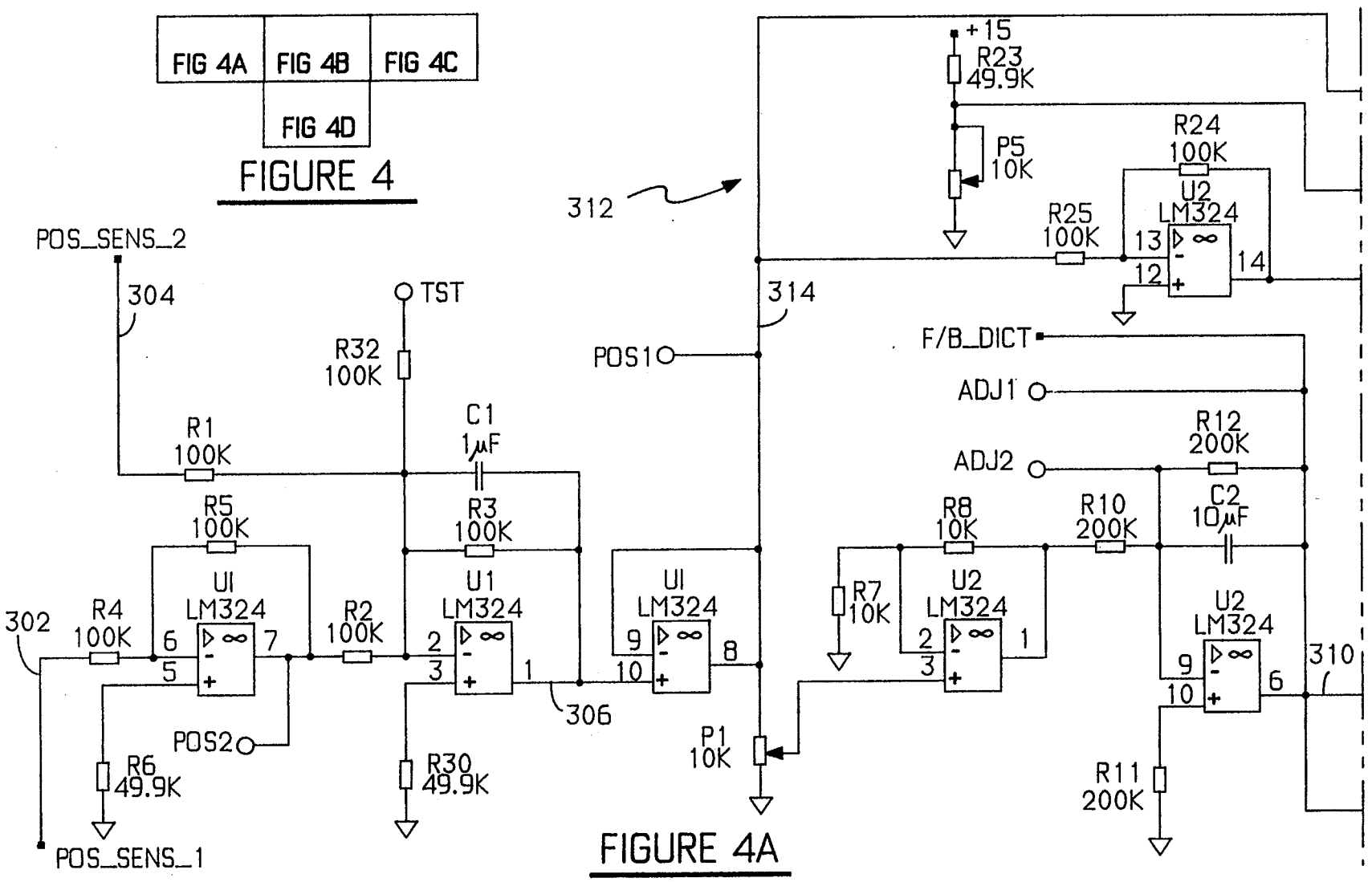
FIG. 4 shows how FIGS. 4A, 4B, 4C and 4D fit together.
FIGS. 4A, 4B, 4C and 4D illustrate a schematic for a single printed circuit (PC) board embodiment of the present invention having both a front-to-back and a side-to-side control on board.
Figure 4B:
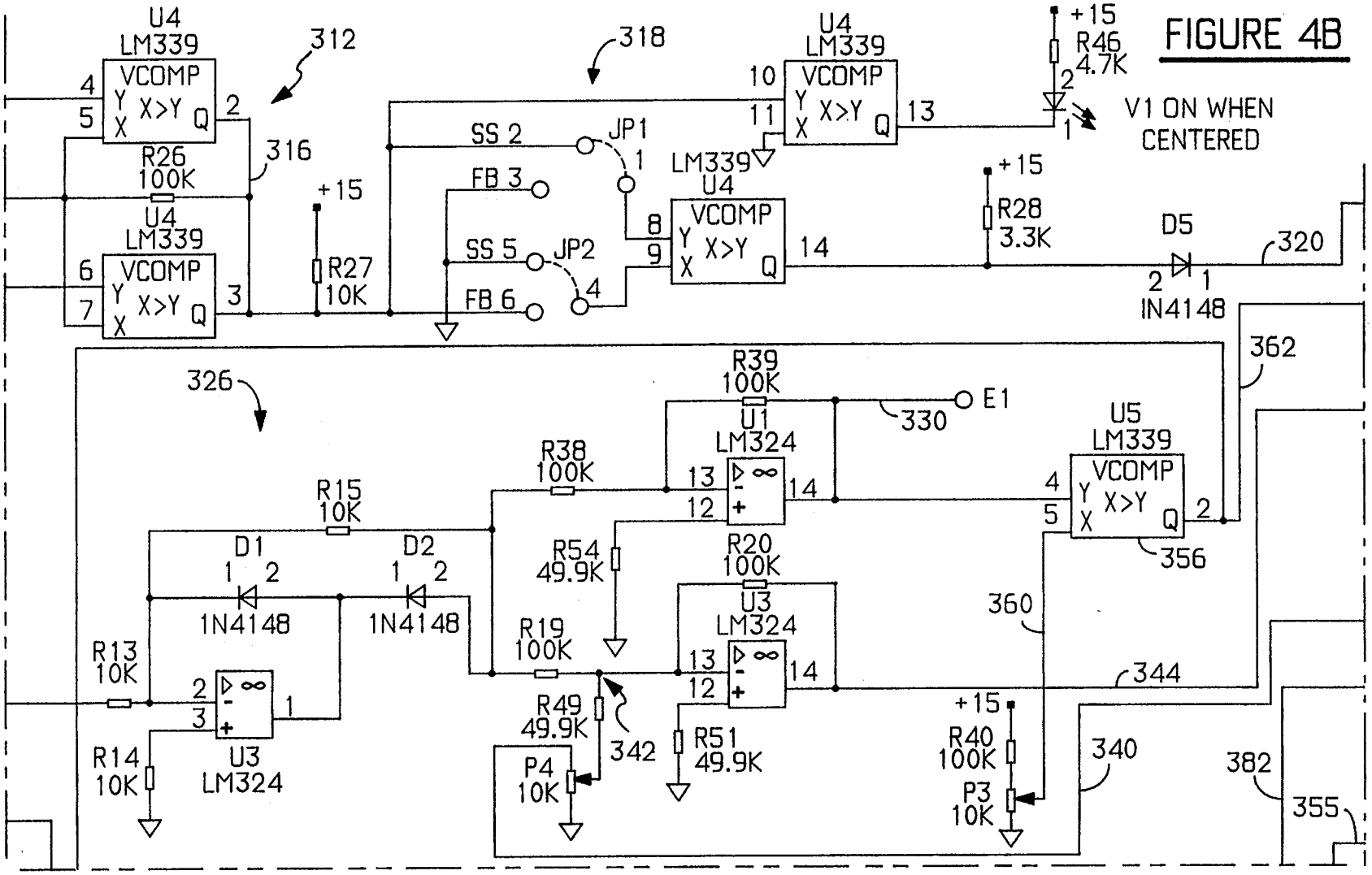
Figure 4C:
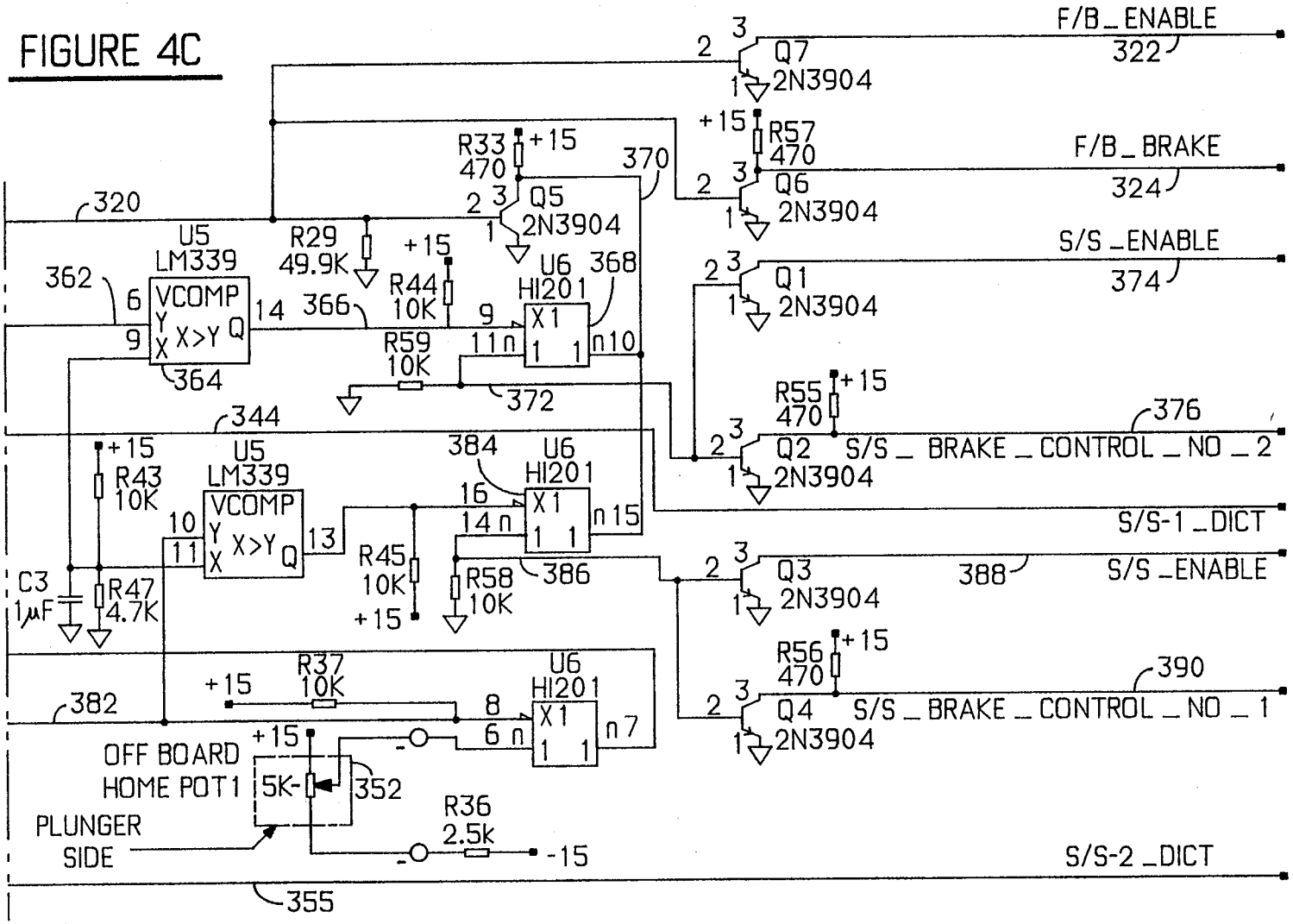

The actuator 10 may include a Bodine brushless DC motor drive such is the type reaching full speed in approximately one-half second and having a dictation range of minus ten to plus ten volts with a dead zone of approximately 0.4 volts, for example. An Inertia Dynamics FSB/FSBR spring applied brake has been used with the Bodine motor drive to carry out the above-described setup. The motor drive may be purchased from Bodine Electric Company, 2500 West Bradley Place, Chicago, Ill. 60618. The particular model used was a Bodine 34X6FEBL motor and type 58043 control. The Inertia Dynamics Inc. brake has a part number of 17034421, Model FSB, 90 volt and may be obtained from Inertia Dynamics Inc. of Collinsville, Conn. U.S.A. at telephone number (203) 693-0231. The driver 70 may be, for example, a standard solid state relay such as the type Crydom series D2W 203F. The window comparator may be made up of simple voltage comparators such as type LM339 and an operational amplifier LM324 as shown in FIGS. 4A–4C below. The above-mentioned type drivers can be used to drive a 115 volt brushless DC control such as provided by Bodine and a brake such as a spring applied brake such as provided by Inertia Dynamics Inc.

Figure 2A:
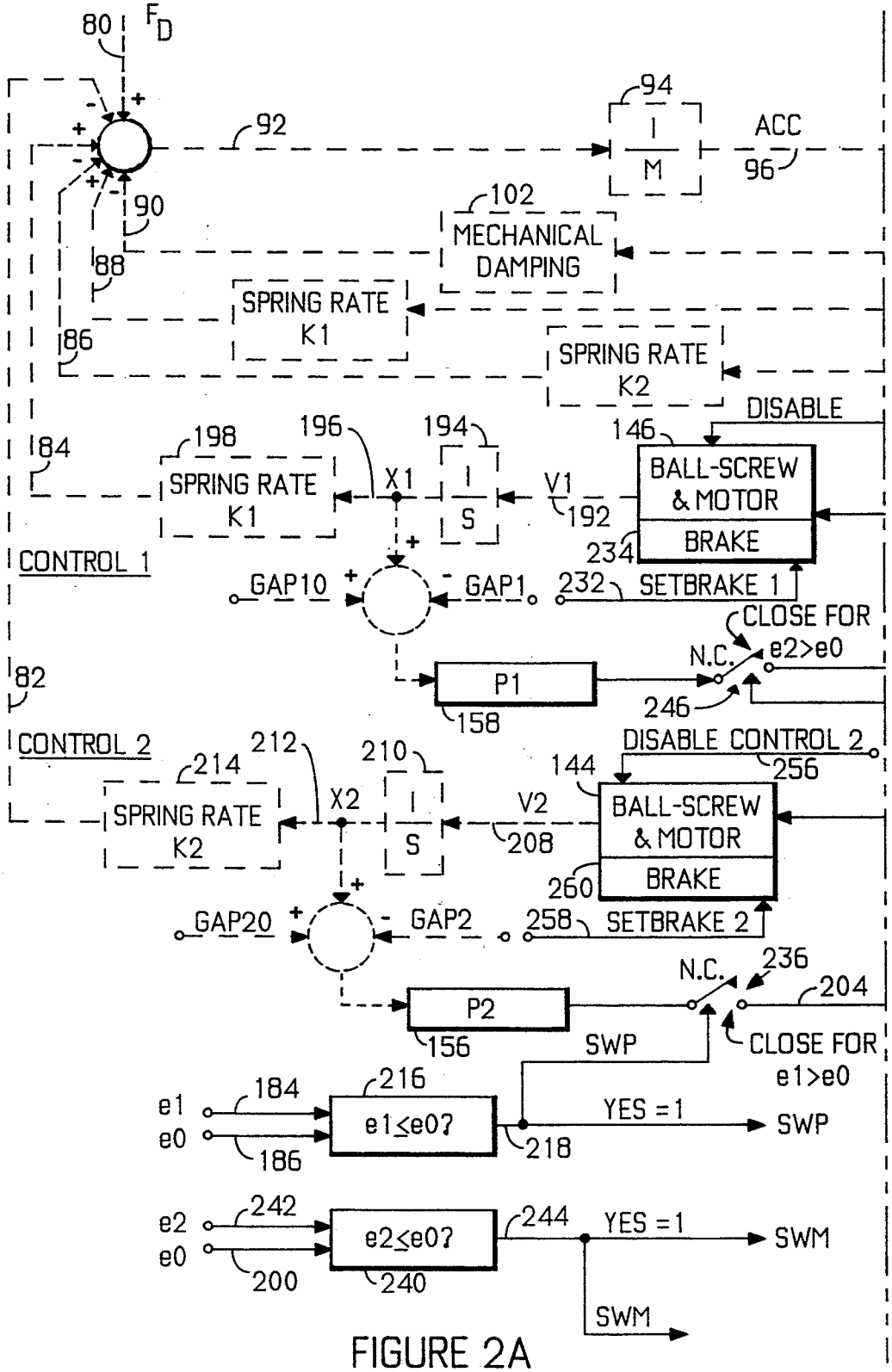
FIGS. 2A and 2B together show a side to side control for an active elevator horizontal suspension, according to the present invention.
Figures 2, 2B:
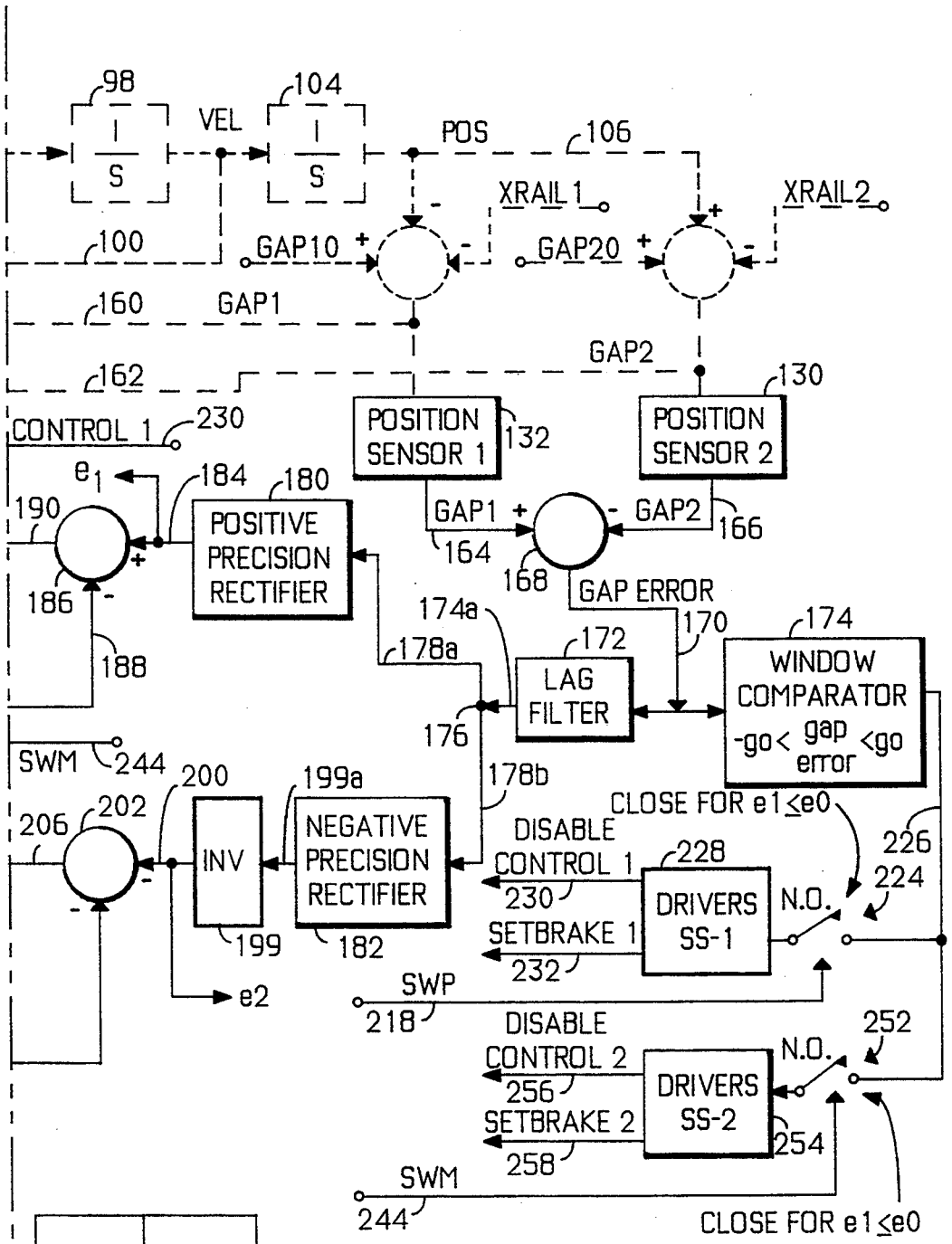
FIG. 2 shows how FIGS. 2A and 2B fit together.

FIGS. 2A and 2B together show the same sort of setup as shown in FIG. 1 except for the more complicated application of a side-to-side control for an active horizontal suspension for an elevator. FIGS. 2A and 2B resemble to some extent the circuitry shown in FIG. 69 of the above-mentioned EPO Publication 0 467 673 A2 and FIG. 9 of the above-mentioned U.S. Pat. No. 5,117,946 except being improved, according to the teachings of the present invention in various respects to be described below.

As suggested above, the side-to-side control problem is complicated by having two opposing actuators on opposite sides of the elevator car aligned with the opposite hoistway rails mounted vertically from top to bottom of the hoistway. When one actuator pushes to center the car the other will naturally have a response and it is important to coordinate the two controls in order to prevent fighting therebetween and to provide a smooth side-to-side centering control. Thus, the control of FIGS. 2A and 2B is essentially the same as that shown in FIG. 1 except having to account for two related controls instead of just one. As in FIG. 1, FIGS. 2A and 2B show, the parts of the system that are particularly controllable by an active control system in solid lines while the other parts of the system are modeled in a linear fashion as shown in dashed lines for simplification purposes. It will be understood, however, that the overall system response is nonlinear and would not be as simple as that illustrated in FIGS. 2A and 2B for teaching purposes.

A disturbing force on a line 80 is summed with a plurality of forces on a plurality of lines 82, 84, 86, 88, 90 which together provide a summed signal on a line 92 to the elevator car as illustrated by a block 94. The force represented by the signal on the line 92 acts on the mass of the elevator car 94 to provide an acceleration as represented on a line 96. The acceleration is integrated in a block 98 to move the car at a velocity as represented on a line 100 which is mechanically damped 102 by the system to provide a damped velocity signal on the line 90. The velocity signal on the line 100 is also integrated by the system as illustrated by a block 104 to provide a positional change in the position of the elevator car as illustrated by a position signal on a line 106.

Figure 3:
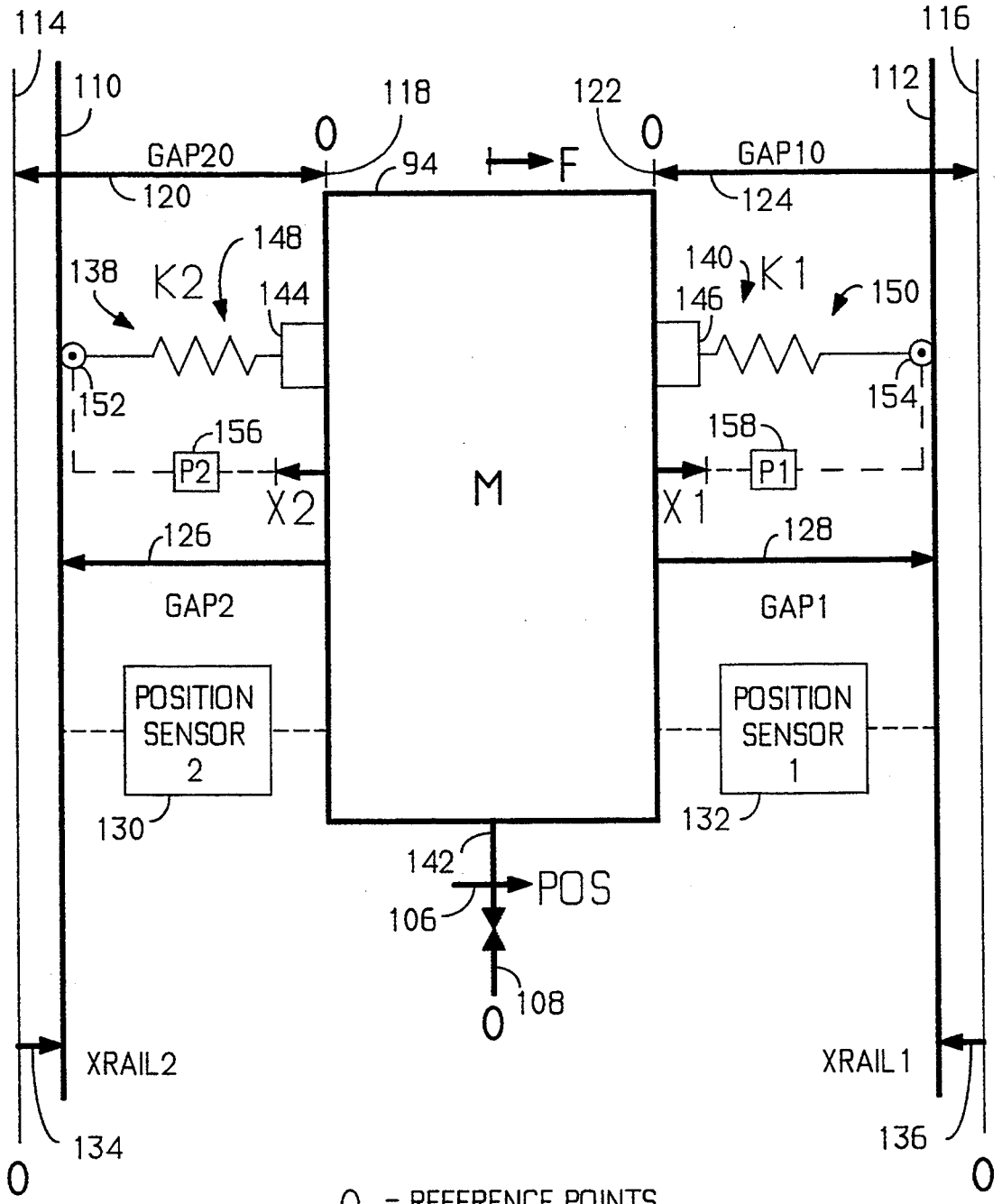
FIG. 3 shows a coordinate system for a side to side centering control such is shown in FIG. 2, according to the present invention

Referring now to FIG. 3, the positional change illustrated by the signal on the line 106 of FIG. 2B is illustrated in FIG. 3 as being related to a horizontal reference position 108 which can be negative to the left of line 108 or positive to the right thereof as illustrated. The reference point 108 may be thought of as a position corresponding to a desired side-to-side, centered position of the elevator car 94 in the hoistway with respect to opposing vertical rails 110, 112 going from the top to the bottom of the hoistway on either side of the car. The opposing rail 110, 112 are shown mounted on opposing hoistway walls 114, 116 in FIG. 3. The distance between a zero reference 118 on the car and the left hand side hoistway wall 114 is illustrated by a distance GAP20 as shown by a line 120. Similarly, a reference position 122 on the right hand side of the car 94 has a distance GAP10 as shown by a line 124 between the right hand side of the car and the hoistway wall 116. Because the rails are not perfectly straight from top to bottom of the hoistway, the distance between the surface of each of the rails 110, 112 and the reference positions 118, 122, respectively, will not be constant and will vary according to the out-of-straightness of the rails 110, 112 as the car travels vertically in the hoistway. These differences in position of the car with respect to the surface of the rail may be illustrated by a pair of lines 126, 128 being labeled GAP2 and GAP1, respectively. The distances GAP2 and GAP1 may be measured by position sensors 130, 132, respectively. Finally, the position of the surface of each of the rails with respect to the associated hoistway wall is shown by a pair of lines 134, 136 being labeled XRAIL2 and XRAIL1, respectively.

Also shown in FIG. 3 are a pair of opposed actuators 138, 140 which together try to keep a vertical center line 142 of the car 94 centered on the line 108. The actuators 138, 140 may be viewed conceptually as having a moveable force part 144, 146 which act on respective springs 148, 150 to keep respective rollers 152, 154 pressed against the surface of the rails 110, 112 with forces selected dynamically, according to changing conditions, to keep the car 94 centered on reference position 108. According to the teachings of the present invention, sensors 156, 158 may be employed to measure the length of the springs 148, 150 thereby providing a direct measurement of the force. This is particularly advantageous in positioning the actuators 144, 146 (may include: ball-screw, motor, and electronic drive) to achieve the desired preload force when the actuator is in a homing mode, to be described below.

Referring back to FIG. 2B, it will be observed that the position signal on the line 106 is shown, at a system level, being summed with the rail position signals and the GAP10 and GAP20 signals in order to provide a GAP1 and GAP2 signal, as shown by lines 160, 162. These positions are shown being operated on by spring rates K1 and K2 to provide the signals on the lines 88, 86 as previously described. The pair of position sensors 130, 132 that were already described in connection with FIG. 3, provide sensed GAP signals on a corresponding pair of lines 164, 166 which are summed in a summer 168 which provides a difference signal (gap error) on a line 170 to a lag filter 172 and, according to the teachings hereof, to a window comparator 174 (with hysteresis). The lag filter 172 may be used, according to the present invention, with a fast time constant on the order of two seconds, for example, for providing a filtered GAP error signal on a line 174*a* to a junction 176 where it is split into a pair of lines 178*a*, 178*b* which may, in reality, be the same signal provided to a positive precision rectifier 180 and a negative precision rectifier 182.

For filtered GAP error signals that are positive, the positive precision rectifier 180 will provide a control signal ($e_1$) on a line 184 to a comparator 186 where it may be summed with a feedback signal on a line 188 for providing an error signal on a line 190 to the actuator 146 as shown in FIGS. 2A and 2B. In response to the error signal on the line 190, the actuator 146 exerts a force, for example, by extending itself as shown in FIG. 3 to compress the spring to force the roller 154 against rail 112 with more or less force. The resulting motion is a velocity as shown on a line 192. The integrator 194 is used to describe the relationship between translation X1 as shown on a line 196 and velocity. X1 is translated into the force on the line 84 by the spring rate K1 shown in a block 198.

Similarly, the negative precision rectifier 182 becomes activated at some point after the GAP error signal on the line 170 becomes negative and which is provided on the line **178*b* in filtered form to be rectified and provided as a rectified signal ($e_2$) on a line 200 to a comparator 202 where it may be compared with a feedback signal on a line 204 for providing an error signal on a line 206 to the actuator 144 for providing a controlled velocity (V2) on a line 208. The integrator 210 is used to relate V2 to X2. The degree of actuator linear extension or retraction X2 as illustrated on a line 212 is the same as shown by X2 in FIG. 3. This positional movement of the actuator 144 is for operating on the spring 148 for providing the force on the line 82 as indicated by a spring rate block 214** being illustrative of the system, as explained previously.

In a manner similar to that already explained in connection with FIG. 1, it is desired, according to the teachings hereof, to disable the actuator control or brake the actuator, or both, when the position signal is within a small window defined by the motor control window comparator 174. However, because of the dual nature of the horizontal side-to-side suspension, it is necessary to determine first which side is to be disabled and braked and which side is to be active. This is very easily done as shown in detail in FIGS. 2A and 2B, but of course could be done in many other different ways as will be appreciated by one of skill in the art, based on the teachings hereof.

According to the teachings of the present invention, a decision or comparison block 216, which may be a voltage comparator, is responsive to the output signal on the line 184 of the positive precision rectifier 180 and also to a reference signal ($e_0$) on a line 186, which may be a selected constant voltage, a zero value, or some other reference. If set to some selected nonzero magnitude, a dead zone is advantageously created to prevent instant switching between sides, as will be appreciated from the full description of both CONTROL 1 and CONTROL 2 which follows. CONTROLS 1 and 2 may be the same except for the precision rectifiers 180, 182 and the inverter 199.

The decision to be made by the block 216 may, for example, be as illustrated in the block 216 of FIGS. 2A and 2B, to determine whether the magnitude of the signal on the line 184 is less than or equal to the magnitude of the signal on the line 186. If so, a one (digital high) value is output on a line 218 which controls both a normally closed switch 236 and a normally open switch 224. It should be noted that in the embodiment shown in FIG. 4 below, an HI201 switch is used in circuit B as being normally closed. But, paired with an inverter (part of LM339 comparator with only +15 V supply), the combination acts as a normally open switch. In any event, a digital high on the line 218 just means that the GAP error signal on the line 170 is zero or negative and hence the positive precision rectifier 180 is not activated and the signal on the line 184 is ineffective to actuate the actuator 146. In that case, it is desired, according to the teachings of the present invention, to close the contact 224 and provide an enable signal on a line 226 to a driver 228 for providing a DISABLE CONTROL 1 signal on a line 230 and a SET BRAKE 1 signal on a line 232 for, respectively, disabling the control for the actuator 146 and for braking the actuator 146 by means of a brake 234, which may be of the same type described above provided by Inertia Dynamics Inc. Only if the GAP error signal on the line 170 is within the window set by the window comparator 174 will the signal on the line 226 be enabled, however. Thus, the driver 228 will not provide the signals on the lines 230, 232 unless the signal on the line 226 is present, meaning that the elevator car 94 of FIG. 3 is within a small positional window centered about the reference point 108. This provides the desired damping and anti-back rotation protection for actuators that are weakly attempting to go in one direction but that can be moved in the reverse direction by an overcoming force.

If, on the other hand, the decision block 216 determines that the signal on the line 184 is greater than the signal on the line 186 then the signal on the line 218 will be a digital zero and such will cause a normally closed contact 236 of a relay (not shown) to close, thereby closing a circuit for a feedback loop represented by the position sensor 156 shown in both FIGS. 2A, 2B and 3. This just means that the GAP error signal on the line 170 is positive and the positive precision rectifier 180 is active in causing the actuator 146 to center the elevator car 94 horizontally with respect to the reference point 108. In that case, digital zero will also be provided on the line 222 and the normally open contact 224 will be open circuited, thereby disabling the drivers 228 and allowing the actuator 146 to operate, as desired, to center the elevator car when the GAP error signal is positive. At the same time, the opposite side actuator 144 can go back to a "home" position to try to achieve, if given enough time, a desired preload condition on the associated roller 152 by means of the associated spring 148 being forced to a desired length, as described below in accordance with another aspect of the present invention.

In a manner similar to that already described in connection with the decision block 216, a decision block 240 is utilized, according to the teachings of the present invention, for comparing the magnitude of the signal on the line 200, being the output of the negative precision rectifier 182 and the inverter 199, and the magnitude of a signal on a line 242 which may equal the signal on the line 186. In that event, if the magnitude of the signal on the line 242 is less than or equal or to the magnitude of the signal on the line 200, then the decision block 240 will provide a digital one output on a line 244 which just means that the GAP error signal on the line 170 is not negative and the negative precision rectifier 182 is not active in activating the actuator 144 of FIGS. 2A, 2B and 3 and therefore it will be desired to provide the digital one on the line 244 to a normally closed contact 246 in a feedback control for actuator 146 thereby keeping the feedback loop open circuited since the positive precision rectifier 180 is in this situation active. The digital "one" on line 244 is also used for closing a normally open contact 252 of a relay (not shown) for providing the signal on the line 226 (if enabled) to drivers 254 for providing a DISABLE CONTROL 2 signal on a line 256 and a SET BRAKE 2 signal on a line 258 to the actuator 144 and a brake 260, respectively. The output signals on the lines 256, 258 from the drivers 254 will of course not be provided if the GAP error signal on the line 170 is not within the window defined by the window comparator 174 as manifested by the signal on the line 226 being high. In that event, the actuator 144 is clamped and its control action damped for the period during which the elevator car is within the positional window defined by the window comparator 174 about the reference point 108 of FIG. 3.

It is a particularly important teaching of the present invention that this clamping and damping action provides a much improved dynamic response of the centering control for the elevator horizontal active suspension control of the present invention.

As mentioned previously, another aspect of the present invention is the nature of the measurement undertaken in the positional feedback loop provided by the position sensors 156, 158 shown in both FIGS. 2A, 2B and 3. According to the teachings hereof, it is particularly advantageous to measure the length of the springs 148, 150 by means of the position sensors 156, 158. By so doing, an exact level of preload force can be achieved. By always going back to the same length of spring during the homing operation, the same preload force will, if not always, in many or most cases be achieved, given enough time. According to this teaching, the home positions for X1 and X2 of FIG. 3 are not set to zero but are chosen, for example, such that X1=−(GAP10−GAP1)=−XRAIL. This condition assures that the length of the spring K1 is always the same, thereby assuring a constant preload on the unselected roller. As described in the above-published patent documents, originally X1 was sensed between the car frame and the end of the actuator and X1 was controlled. Now, according to the teachings of the improvement hereof, the position sensor may be used to measure the distance from the rail to the end of the actuator. This distance is simply the length of the spring. What works on one side, works equally well on the other side.

Thus, in summary CONTROL 1 and CONTROL 2 of FIGS. 2A and 2B are very similar except for being activated by signals of different sign. Either CONTROL 1 or CONTROL 2 are selected to be the primary centering control by the polarity of the GAP error signal on the line 170. The unselected control is operated so as to obtain the correct preload on the associated roller according to the coordinate system shown in FIG. 3. The additional position sensors P1 and P2, according to the present invention, are used to set the unselected centering loop to its home position. The home position assures a proper preload on the unselected roller. The block diagram of FIGS. 2A and 2B shows the brake control and switches used for selecting the position feedback. Note that position feedback is used when the control is "unselected." For example, when "$e_1$" is positive "$e_2$" will be zero. "$e_0$" may be used to define a dead zone. For the indicated condition, the upper switch remains open and the lower switch closes for "$e_1$" just slightly greater than zero. The condition on "$e_1$" selects control one to take care of unbalances. CONTROL 2 goes into its home seeking state with its position loop closed.

Note that the centering controls (CONTROL 1 and CONTROL 2) are either:

- idle with the motor brake set; or
- operating to center the car using sensor one and sensor two (the GAP sensors); or
- operating in a homing position loop to set the preload on the unselected roller.

It is also a teaching of the present invention that the front-to-back and side-to-side centering controls of FIGS. 1 and 2 can be embodied in a single printed circuit board as illustrated in FIGS. 4A, 4B and 4C which fit together as shown in FIG. 4. In FIG. 4A, a differential amplifier 300 is shown fulfilling the role of the differential comparator 168 of FIG. 2B wherein a position signal on a line 302 corresponds to the GAP1 signal on the line 164 of FIG. 2B while a position signal on a line 304 corresponds to the GAP2 signal on the line 166. An output of the differential comparator 300 on a line 306 corresponds to the GAP error signal on the line 170 of FIG. 2B.

A gain and compensation network 308 as shown in FIG. 4A corresponds to the lag filter 172 shown in FIG. 2B and provides an output signal on a line 310 corresponding to the lag filter output signal on the line 174 of FIG. 2B.

In accordance with the teachings hereof, the network 308 may be used for a front-to-back control such as shown in FIG. 1 by not using or instead using a fixed reference at one of the differential amplifier inputs and using the sensed GAP at the other input of the differential amplifier. Hooked up in this way, the front-to-back gain and compensation network 60 of FIG. 1 would also be served by the gain and compensation network 308 of FIG. 4A. However, instead of the output on the line 310 going to the negative and positive precision rectifiers of FIGS. 4B and 4D, to be described below in connection with the side-to-side control, the front-to-back control 64 of FIG. 1 would then be controlled by the signal on the line 310 directly serving (F/B_DICT) as the signal on the line 62 of FIG. 1 for controlling the actuator 10 thereof.

A window comparator 312 corresponding to the window comparator 174 of FIG. 2 and also the window comparator 66 of FIG. 1 is shown partially in FIG. 4A and partially in FIG. 4B. Its role is to respond to a GAP signal on a line 314 for providing an enable signal on a line 316. The GAP signal on the line 314 corresponds to the sensed GAP signal on the line 54 of FIG. 1 (when used for a front-to-back control) and to the GAP error signal on the line 170 of FIG. 2B (when used in a side-to-side control). Similarly, according to the usage of the PC board, the enable signal on the line 316 of FIG. 4B corresponds to the enable signal on the line 68 of FIG. 1 or to the enable signal on the line 226 of FIG. 2B. The circuitry of FIG. 4 can of course only be used as one or the other of a front-to-back or side-to-side control as selected in the field. This may be selected by the installer or in the factory according to the jumper positions selected as shown in FIG. 4B by a pair of jumpers 318 shown in the example hooked up by a pair of dashed lines JP1 and JP2 for a side-to-side control. A front-to-back control use would require hooking up jumper JP1 from node i to node FB3 and the jumper JP2 from node 4 to node FB6. This will result in a signal on a line 320 being low for a side-to-side hook up when the car is centered and high for a front-to-back hookup when the car is centered. Turning to FIG. 4C, this will in turn result in a front-to-back enable signal on a line 322 being low when the car is centered and, correspondingly, a front-to-back brake signal on a line 324 being low when the car is centered. These signals correspond to the negatives of the signals previously described on the lines 74 and 76 of FIG. 1. It should be realized, however, that a different design could avoid the use of jumpers.

For a side-to-side control, the signal on the line 310 of FIG. 4A, corresponding to the signal on the line 174 of FIG. 2B, is provided to a pair of precision rectifiers 326, 328 that correspond to the positive and negative precision rectifiers 180, 182, respectively, of FIG. 2B. An E1 signal on a line 330 corresponds to the signal ($e_1$) on the line 184 of FIG. 2B while a signal (E2) on a line 332 of FIG. 4D corresponds to the signal ($e_2$) on the line 200 of FIG. 2B.

The output of the positive precision rectifier 326 is summed with a feedback signal on a line 340 at a junction 342 which is amplified and provided on a line 344 as a first side-to-side dictation signal similar to the command signal on the line 190 of FIGS. 2A and 2B. Similarly, negative precision rectifier 328 provides an output signal on the line 332 which is amplified and provided on a line 346 for summation with a feedback signal on a line 348 at a junction 350. It will be noted that the signal on the line 350 of FIG. 4D is provided after amplification as a signal on a line 355 for side-to--side dictation similar to the signal on the line 344 except on the other side of the elevator car.

In both side-to-side and front-to-back cases, off-board (meaning not on the circuit board) potentiometers 352, 354 are utilized to sense the positions of the respective actuators. These potentiometers 352. 354 of FIGS. 4C and 4D, respectively, correspond to the potentiometers 158. 156, respectively, of FIG. 2A.

FIG. 4B also shows a comparator 356 associated with the positive precision rectifier 326 and a comparator 358 associated with the negative precision rectifier 328. These correspond to the decision blocks 216, 240, respectively, of FIG. 2A. In the comparator 356, a decision is made as to whether or not the signal E1 on the line 330 is less than or equal to a reference signal on a line 360 corresponding to the $e_0$ signal on the line 186 of FIG. 2A. In the event that $E_1$ is less than or equal to the signal on line 360 then a signal on a line 362 becomes high. This signal is also shown in FIG. 4C being applied to a comparator 364 which in turn provides an output on a line 366 to an analog normally-closed switch device 368. The devices 364, 368 in combination form what may be viewed as a normally-open switch such as the normally open switch 252 of FIG. 2B. As already explained in connection with FIG. 2B, when the window comparator detects the elevator car in the small selected region about the center line 108 then it enables its output and the "normally-open" switch 364, 368 will be responsive thereto on a line 370 for driving a signal line 372 high thereby energizing a pair of transistors Q1, Q2 for driving low the side-to-side enable and brake control signal lines 374, 376 similar to the lines 230, 232 of FIG. 2B, respectively.

Figure 4D:
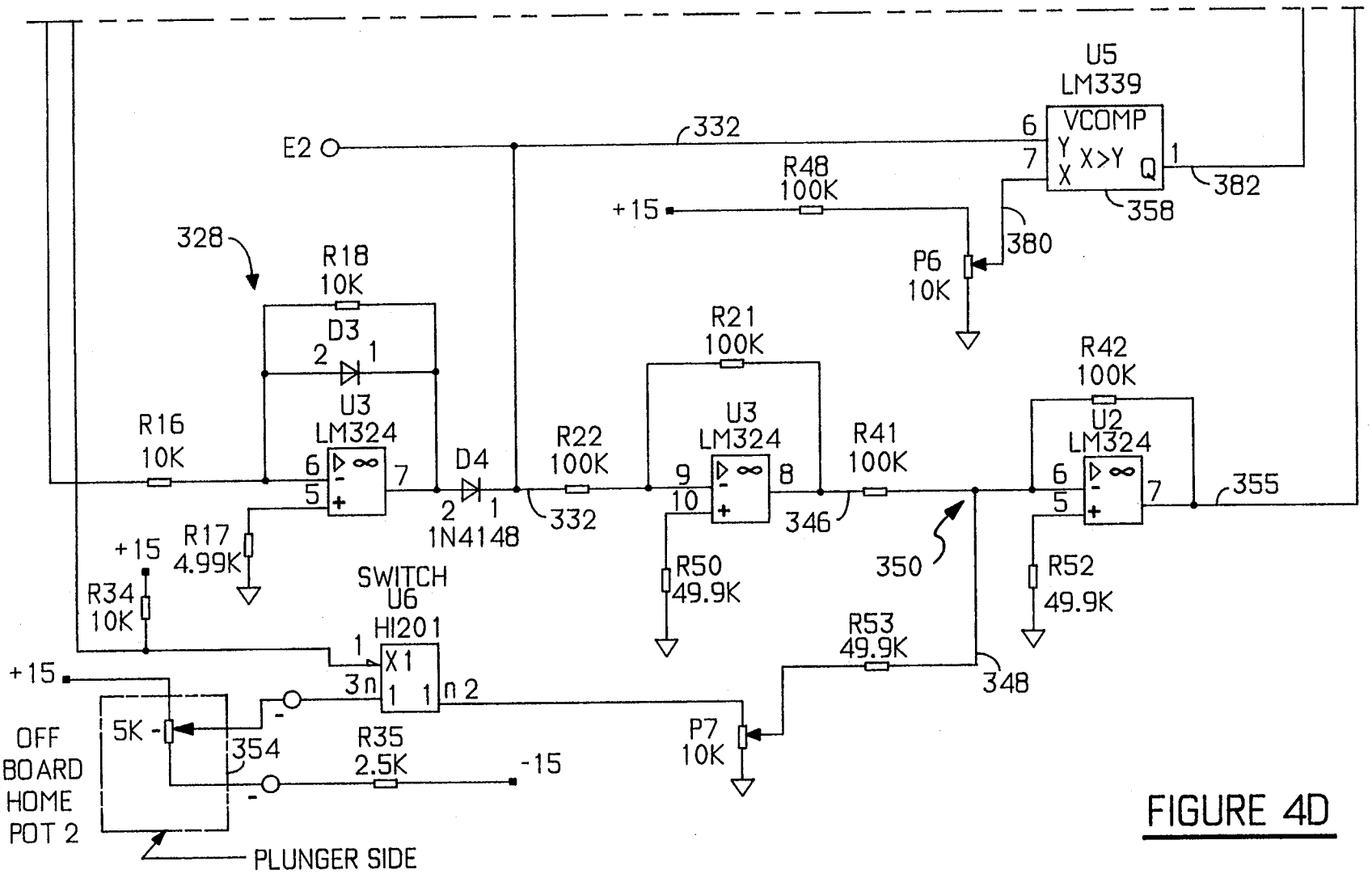

Similarly, the comparator 358 of FIG. 4D is similar to the comparator 240 of FIG. 2A and compares the magnitude of the E2 signal on the line 332 to a reference signal on a line 380. It provides an output signal on a line 382 corresponding to the SWM signal on the line 244 of FIG. 2A for causing a switch 384 to close in order to switch through the signal on the line 370 onto a signal line 386 for driving a pair of transistors Q3, Q4 for driving a pair of signal lines 388, 390 low, thereby causing the other side of the elevator car actuator brake to be engaged and its control disabled.

Thus, it will be appreciated that the front-to-back control of FIG. 1 and the side-to-side control of FIGS. 2A and 2B may be implemented on a single circuit board as shown in FIGS. 4A, 4B, 4C and 4D which together form such a circuit as shown in FIG. 4. This provides a great advantage in avoiding a need for separate circuit boards for the two different types of control.

Although the invention has been shown and described with respect to a best mode embodiment thereof, it should be understood by those skilled in the art that the o foregoing and various other changes, omissions and additions in the form and detail thereof may be made therein without departing from the spirit and scope of the invention.

What is claimed is:

1. An improved centering control for an elevator having a horizontal suspension comprising a passive, mechanical part and an active, electromechanical part including an actuator, the centering control comprising means responsive to an error signal indicative of a difference between a reference signal and a sensed signal, for providing a control signal for controlling the actuator, the improved centering control further comprising:

means responsive to the sensed signal and to a second reference signal indicative of a centered condition of the elevator for providing one or more control signals for disabling the control and for braking the actuator in the presence of the centered condition.

2. The improved centering control of claim 1 wherein the means for providing one or more control signals is a window comparator.

3. The improved centering control of claim 2, wherein the error signal has a negative or positive polarity and wherein the window comparator has positive and negative thresholds for providing the one or more control signals when the error signal is more positive or negative than the positive or negative thresholds, respectively.

4. The improved centering control of claim 1, wherein the sensed signal is a position signal.

5. An improved centering control for an elevator having a horizontal suspension including an electromechanical actuator, the control comprising means responsive to an error signal indicative of a difference between a selected centered reference horizontal position signal indicative of an outer boundary of a range of centered horizontal positions of the elevator and a sensed horizontal position signal indicative of a horizontal position of the elevator, for enabling an actuator control signal for controlling the actuator, the improved centering control further comprising means responsive to the sensed horizontal position signal and to a second reference signal for providing a second control signal for braking the actuator and for disabling the actuator control signal in the presence of the error signal having a magnitude indicative of the horizontal position of the elevator within the range of centered horizontal positions of the elevator.

6. The improved control of claim 5, wherein the means for providing the second control signal is a window comparator.

7. The improved centering control of claim 6, wherein the error signal has a negative or positive polarity and wherein the window comparator has positive and negative thresholds for providing the second control signal when the error signal is more positive or negative than the positive or negative thresholds, respectively.

8. An improved centering control for an elevator car having a horizontal suspension having first and second opposed electromechanical actuators, the control comprising means responsive to an error signal having a magnitude indicative of first and second sensed signals respectively corresponding to parameters of the first and second opposed actuators, for only providing one at a time of first and second actuator control signals for respectively actuating the first and second opposed actuators for correspondingly actuating the elevator car, in only one direction at a time, wherein the improved centering control further comprises:

means responsive to the error signal for providing a first set of disable and brake control signals for disabling the first actuator control signal and for braking the first actuator for a first selected range of magnitudes of the error signal in a centered condition of the elevator car; and means responsive to the error signal for providing a second set of disable and brake control signals for disabling the second actuator control signal and for braking the second actuator for a second selected range of magnitudes of the error signal in the centered condition of the elevator car.

9. The improved centering control of claim 8, wherein the control includes a feedback control for each actuator for returning each actuator to a preselected preload force only when the corresponding actuator control signals is disabled.

10. The improved centering control of claim 9, wherein the feedback control is based on a position sensor that senses the position of the actuator with respect to a position reference related to the preselected preload force.

11. The improved centering control of claim 9, wherein the feedback control for each actuator is based on an associated position sensor that controls the length of a corresponding spring part of the actuator for controlling the spring to a preselected length corresponding to the preselected preload force.

12. An improved centering control for an elevator car having a horizontal suspension including first and second opposed electromechanical actuators, the centering control comprising means responsive to an error signal having a magnitude indicative of a difference between first and second sensed signals, for only selecting one of the opposed actuators to be actuated at a time for correspondingly actuating the elevator car in only one direction at a time, wherein the improved centering control further comprises:

means responsive to the error signal for providing a first disable signal for disabling the first actuator and for providing a first braking control signal for braking the first actuator for a first selected range of magnitudes of the error signal; and means responsive to the error signal for providing a second disable signal for disabling the second actuator and for providing a second braking control signal for braking the second actuator for a second selected range of magnitudes of the error signal.

13. The improved centering control of claim 12, wherein the control includes a feedback control for each actuator for returning each actuator to a preselected preload force only when the actuator is disabled.

14. The improved centering control of claim 13, wherein the feedback control is based on a position sensor that senses the position of the actuator with respect to a position reference related to the preselected preload force.

15. The improved centering control of claim 13, wherein the feedback control for each actuator is based on an associated position sensor that senses the length of a corresponding spring part of the actuator for controlling the spring to a preselected length corresponding to the preselected preload force.

16. An improved centering control for an elevator car having a horizontal suspension including first and second opposed electromechanical actuators, the centering control comprising means responsive to an error signal having a magnitude indicative of first and second sensed signals respectively corresponding to parameters relating to the first and second opposed actuators, for only selecting one of the opposed actuators to be actuated at a time for correspondingly actuating the elevator car in only one direction at a time, wherein the improved centering control further comprises:

a first feedback control for the first actuator for returning the first actuator to a preselected preload force only during a first period when the first actuator is not selected to be actuated wherein the first feedback control is disabled during a second period when the first actuator is selected to be actuated; and a second feedback control for the second actuator for returning the second actuator to a preselected preload force only during the second period when the second actuator is not selected to be actuated wherein the second feedback control is disabled during the first period when the second actuator is selected to be actuated.

17. A control for an actuable horizontal suspension for an elevator, comprising:

a printed circuit board having two distinct controls wherein only one of the controls is usable at a time, comprising:

a side-to-side control, responsive to a pair of sensed side-to-side position signals, for providing a side-to-side control signal for actuating a side-to-side suspension; and a front-to-back control, responsive to a sensed front-to-back position signal, for providing a front-to-back control signal for actuating a front-to-back suspension, wherein the printed circuit board includes a window comparator, responsive to the side-to-side position signal or to the front-to-back position signal, for respectively providing first and second pairs of side-to-side brake and control disable signals or a single pair of front-to-back brake and control disable signals.

* * * * *